United States Patent [19]

Nagel

[11] Patent Number: 4,770,301

[45] Date of Patent: Sep. 13, 1988

[54] HIGH SPEED DUPLICATOR WITH COPY SHEET PREPACKAGED SHIPPING AND LOADING CARTON

[75] Inventor: Richard H. Nagel, Pittsford, N.Y.

[73] Assignee: Xerox Corporation, Stamford, Conn.

[21] Appl. No.: 654,706

[22] Filed: Sep. 27, 1984

[51] Int. Cl.[4] ..... B65D 83/00

[52] U.S. Cl. ..... 206/556; 206/449; 206/605; 206/815; 229/23 R; 229/52 A

[58] Field of Search ..... 206/449, 451, 454, 555, 206/556, 605, 815; 229/33, 36, 41, 175, 23 R, 52 A, 52 B, ; 271/144, 145, 161-163, 167, 169

[56] References Cited

U.S. PATENT DOCUMENTS

| | | | |
|---|---|---|---|
| 2,600,927 | 6/1952 | Scoville | 206/57 |
| 2,725,172 | 11/1955 | McCullough et al. | 229/16 |
| 3,360,258 | 12/1967 | Nix | 206/449 |
| 3,367,487 | 2/1968 | Dwyer, Jr. | 206/57 |
| 3,767,188 | 10/1973 | Rosenberg, Jr. et al. | 229/175 |
| 3,955,671 | 5/1976 | Ockey | 206/44 R |
| 4,085,884 | 4/1978 | Hogenett et al. | 271/145 |
| 4,091,984 | 5/1978 | McFarland | 229/23 BT |
| 4,185,745 | 1/1980 | Moser et al. | 206/556 |
| 4,317,536 | 3/1982 | Dickerson | 229/23 R |

*Primary Examiner*—Jimmy G. Foster

*Attorney, Agent, or Firm*—William A. Henry, II

[57] ABSTRACT

A disposable carton is disclosed which is adapted to hold a supply of copy sheets equivalent to a plurality of reams for a printing machine. The carton is constructed of two main portions which is removed to expose the stack and permit the operator to carry the stack to a sheet supply platform without disrupting the stack. The remaining portion of the carton which serves to permit the operator to place the stack upon the platform is adapted to be slideably removed from under the stack thus effecting the loading of the stack in the printing machine preparatory to the sheet feed operation.

6 Claims, 2 Drawing Sheets

11
12
13
15
16
17
18
P

HIGH SPEED DUPLICATOR WITH COPY SHEET PREPACKAGED SHIPPING AND LOADING CARTON

This invention relates to a high productivity reproduction system, or copying machine, having sheet supply arrangements involving very large quantities of copy sheets for use in such system.

With the advent of higher speed and more sophisticated copy producing machines, printing presses, and the like, considerations as to how the mass of copy sheet supply can best and most effectively be handled has assumed increasing importance. For high productivity copiers or duplicators, copy sheet supply apparatus utilize supply trays which are adapted to hold three to five and even more reams of copy sheets. This type of copy sheet supply requires the operator to load the paper supply tray with a plurality of prepackaged reams of copy sheets, one ream at a time, thereby necessitating repeatedly shutting down the duplicator for a considerable length of time so as to permit the breaking open of the prepackaged reams and loading of the sheet supply tray with the individually handled reams of sheets. This entailed unpackaging individual reams and placing each ream on the elevator platform for the sheet supply using caution that each ream of sheets is correctly placed on an earlier placed ream. Building up a supply tray holding five or more reams involved time which required machine shutdown and consequently loss of productivity as well as requiring many manipulative steps by the operator to accomplish.

A bulk package of copy sheets is disclosed in U.S. Pat. No. 3,367,487 and is adapted to be placed on the delivery platform of a copier. However, the disclosed carton does not lend itself to be dismantled while on a copier platform which is deeply recessed into the copier. The disclosed carton merely provides the operator with many reams of paper which is placed on the platform, and evidently left there for the dispensing of sheets. The package in such operative position cannot be used in printing machines having a bottom sheet feeder or a top feeder working in conjunction with an upwardly movable elevator. In the latter use, the package would become crushed between the elevator platform and the internal structure of the machine, thereby potentially damaging the machine, and in any event causing sheet jamming.

It is, therefore, the object of the present invention to permit the loading of a very high speed printing machine such as a copier or duplicator with a supply of copy sheets quickly and easily and to eliminate copier shutdown for this purpose.

The present invention includes a copy sheet container adapted for shipping and storage of a large stack of sheets. The container or carton is capable of being loaded during assembly and manufacturing with sheets of paper equivalent to a plurality of reams of copy sheets. The container may be applied directly to the sheet supply for a printing machine such as being placed upon the elevator platform of the sheet feeding apparatus of the machine. Means are provided so that the portions of the container which were placed on the platform with the stack can be removed so that the stack and the sheet feeding apparatus are cleared of the container or any portions thereof during operation.

Other objects and advantages will be apparent from the ensuing description and drawing in which.

Figure 1:
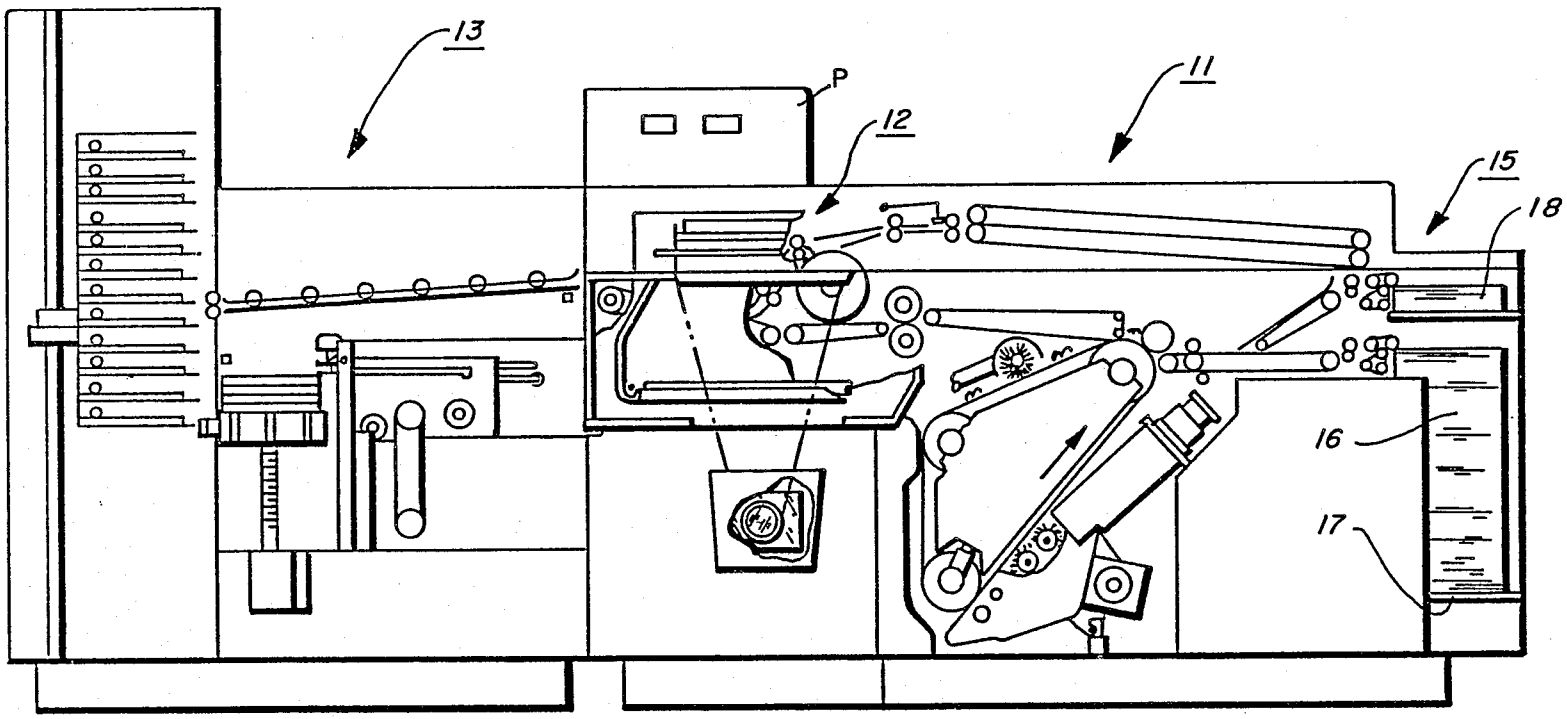
FIG. 1 is a schematic illustration of a configuration of an electrostatographic printing system to which the present invention may be utilized.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commercial embodiment of the Xerox duplicators, models 9400® and 9500® which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1. It is understood that any other type of printing machine may incorporate or use the present invention.

The system comprising the processor 11 and the document handling apparatus 12 is under control of a programmer P which permits an operator various options: to turn the entire system ON or OFF: to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

The copier/duplicator system shown in FIG. 1 is representative of systems which are capable of producing 120 and more image impressions per minute. For simplex or one sided copying, this can result in producing 120 copies per minute to more. In order to accomplish fairly long reproduction runs, the main copy sheet supply subsystem for the system, the main copy sheet holding tray is adapted to hold five reams of sheets. At 500 sheets per ream, five reams totals out to involve 2500 sheets. At a production rate of 120 copies per minute, it can be estimated that five reams will last approximately 21 minutes before needing reloading. For a long run, it can be envisioned that an operator will spend considerable time reloading the main sheet supply tray.

Reloading five reams requires that the copying system be shut down, that each ream must be broken open and the sheets accurately positioned on the tray bottom for the sheet supply tray, which is usually an elevator platform. Generally, these platforms are only inches from the floor and are deeply recessed into the copier housing thus necessitating many cycles of up and down bending and leaning of the operator's body to accomplish a little over 21 minutes of copier use before another cycle of reloading will be required. The present invention is directed to a sheet holding container such as a carton which is conditioned to be momentarily applied to a sheet supply tray of a copier and be provided with a removable bottom plate upon which a relatively large number of copy sheets were previously inserted during manufacturing of the copy sheets so that upon removal of the bottom plate, the pre-loaded copy sheets will be exposed upon the supply tray in proper orientation and in a neat stack. It is envisioned in the copier system disclosed herein that 2500 sheets are contained in the carton which together with the sheets were packaged by a copy sheet paper manufacturer as a unitary container of paper much the same as a packaged ream is manufactured.

The sheet holding carton in the present invention may be loaded while the copier is running with the use of an auxiliary sheet supply while 2500 copy sheets can be quickly added.

Figure 2:
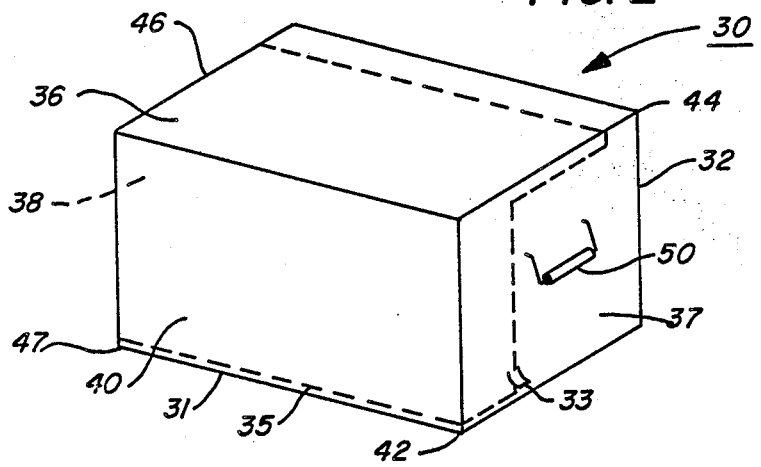
FIG. 2 is an isometric of the shipping and dispensing carton of the present invention.

As shown in FIGS. 1 and 2, the copier/duplicator system 11, 12 and 13 is typically provided with a copy sheet supply station 15 at one end of the system. This station may include a main sheet supply 16 having an elevator platform 17 which serves as the support or holding tray for five or more reams of copy sheets, and an auxiliary tray 18 which may contain one ream. In the conventional manner, as shown in FIG. 2, the main sheet supply includes the elevator platform 17 upon which five or more reams of copy sheets are placed.

The loaded, prepackaged supply carton of the present invention is shown in FIG. 2 by the reference numeral 30. The carton comprises two main sections 31 and 32, front and rear, respectively, joined and held together during shipping and storage, or non-use by a tear strip or tab 33. The tab is circumferentially applied to the carton in a manner such that the sections 31, 32 become completely separated, expose the stack of sheets S contained therein, and provide a bottom panel 35 still remaining with the rear section 32 for supporting the stack when the sections 31 and 32 are disassembled.

When assembled as shown in FIG. 2, the carton 30 comprises the bottom panel 35, a top panel 36, side panels 37, 38, rear panel 39, and front panel 40. The rear panel 39 is hingedly connected integrally to the rear edge of the bottom panel, while the side panels 37, 38 are partially hingedly connected integrally with the side edges of the bottom panel, and the front panel 40 and the remaining portions of the side panels are connected to the botton panel by a tab.

Preferably, the tear tab 33 separaes the main sections 31, 32 in this manner: starting from a front lower corner 42 of the carton, proceeding to the rear along the side edge of the panel 35 to about a third-of-way point, travelling upwardly generally along a vertical line to the side edge of te top panel 36 then proceeding along this side edge to the upper rear corner 44 of the carton, travelling along the rear edge of the top panel 36 to the opposite upper rear corner 45, then toward the front of the carton along the other side edge of the top panel to a point 46 about two thirds of the way, then proceeding vertically downward on the side panel 38 to a point on the other side edge of the bottom panel and forward to a point 47 on the other front lower corner 47 of the carton and finally across the front edge of the bottom panel to the starting point 42. With the tear tab following this route, the separation of the sections 31 and 32 will result in these sections being generally alike in shape, but with the rear section 32 larger. The route may include round instead of square corners and may vary somewhat from that disclosed. It is important, however, for the front or open edge of the bottom panel be clear of carton material derived from the removed front panel 40 so that the stack S may be easily slid from thereunder.

As shown in the drawings, the main section 32 is provided with a handle 50 on both sides at midpoint thereof to facilitate the operator in transporting the bottom panel with the stack thereon from a support surface during conditioning thereof preparatory to loading the stack upon the elevator platform 17 for the sheet feeding apparatus 15. Any suitable types of handle may be used, but is preferable that it be of a type which may be recessed within the side panels 37, 38.

Figure 4:
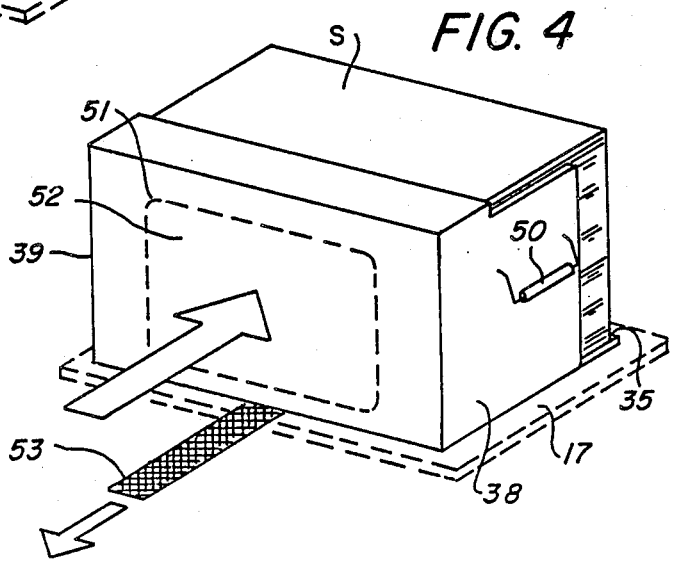
FIG. 4 is an isometric view of the carton showing the same and a stack of paper loaded on to the elevator for the system of FIG. 1 preparatory to being removed.

As shown in FIG. 4, the rear panel 39 is formed with a perforated line 51 surrounding a relatively large size area of material 52, which permits the operator to push out this material contained within the line after applying a thumbnail along the line. A pulling device such as a handle/strap 53 is provided on the carton or may include a cord attached to the lower rear corners of the bottom panel 35. As will be seen below, the pulling device serves to separate the stack S from the remaining main section 32 of the carton.

Further structural relationships will be discussed below during the description of handling and use of the carton. When fully assembled and preloaded with a stack of copy sheets, the carton assumes the construction illustrated in FIG. 2, as it is handled during shipping and storage. When a need occurs for copy sheets in the processor 11, the operator places the carton on a suitable support such as a table top still in the orientation of FIG. 2.

Figure 3:
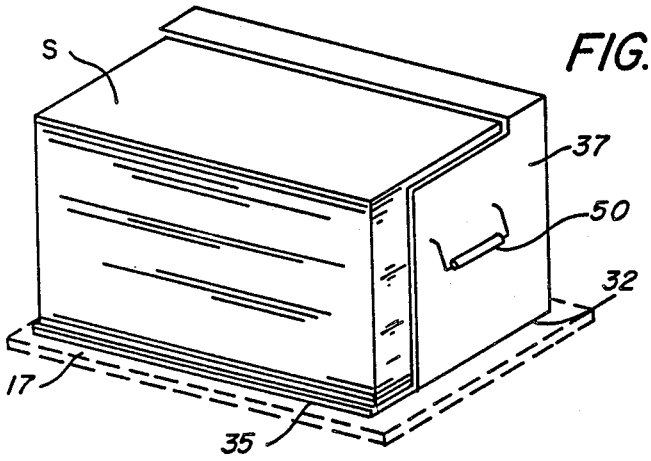
FIG. 3 is an isometric view of the carton with a portion thereof removed for exposing a stack of sheets.

For the initial step, the operator pulls an exposed end of the tear tab 33, continues pulling on the tab along its entire path, and finally removing the same from the carton. The main section 31 is separated from the section 32 and disposed of, thus leaving the section 32 with the stack S supported on the bottom panel, as shown in FIG. 3. The operator manually lifts the section 32 with the stack therein onto the platform 17 ready for use in the sheet feeding apparatus 15, as shown in FIG. 4.

After the section 32 has been placed upon the platform 17, the operator places a hand against the panel material 52 to immobilize the stack S, and, while in coordinated action, slowly pulls the stack support panel 35 from under the stack S, using the handle/strap 53. As the panel 35 is being pulled in the direction of the small arrow, it slides between the platform and the bottom sheet of the stack and the material 52, with the operator's hand thereagainst applying pressure in the direction of the large arrow, holds the sheets of the stack from moving back with the panel 35. A stiffer, larger panel the size of the back panel 39 may be added to the carton behind the area 52 to aid in maintaining the sheets in alignment during this step. After the section 32 has been removed, the material 52 is removed leaving the stack S upon the platform 17 ready for use by the sheet feeding apparatus.

Other forms of a handle may be utilized in place of the handle/strap 53 for pulling the stack support panel 35 out from under the stack S. For example, a cord or rope attached at its ends to the corners of the panel 35 may be used, or other forms made from the carton material. In any event, it is important that the pulling device be in the same plane as the panel 35 so that this panel, rather than the section 32, is directly pulled. With the relatively large weight of the stack resting on the panel 35, a pulling force on any other part of the section not in the plane of the stack support panel may deform and collapse the other structure of the carton and place the stack in some disarray.

From the foregoing, it will be appreciated that the present invention provides a quick and easy means for loading large quantities of copy sheets into a sheet feeding apparatus of a printing machine. Particularly significant is the provision of collapsible structural components of a carton which permits this loading in a feeding apparatus which is deeply recessed in the copier structure thus making it difficult to load even at the conventional rate of one ream at a time. The carton has been devised to be easily and quickly loaded with copy sheets at the manufacturer's plant and to be easily and quickly disassembled by the operator during loading.

While the invention has been described to the structure disclosed, it is not confined to the details set forth, but is intended to cover such modifications or changes as may come within the scope of the following claims.

I claim:

1. A carton in combination with a stack of sheets adapted for shipping and storage, and for permitting an operator to present the stack of sheets for use in a printing machine having a sheet feeding apparatus and a sheet supply platform for supporting copy sheets during operation of the machine, comprising, a first section having a bottom panel for supporting the stack of sheets of paper therein, a second section adapted to be connected to said first section and being adapted to be separated therefrom to expose the stack of sheets during preparation of the carton for loading in the printing machine, said first section being adapted to be manually positioned upon the platform to place said bottom panel with the stack supported thereon on top of the platform and with the top of the stack in operating association with the sheet feeding apparatus, and means for permitting the operator to slideably remove said bottom panel of said first section relative to the platform and the stack and thereby effect the placement of the stack of sheets upon the sheet supply platform.

2. A disposable carton in combination with a stack of sheets adapted for shipping and storage, and for permitting an operator to present the stack of sheets for use in a printing machine having a sheet feeding apparatus and a sheet supply platform for supporting copy sheets during operation of the machine, comprising, a first main section having a bottom panel and a panel hingedly connected to said bottom panel along a fold line for supporting a stack of copy sheets of paper therein, a second main section adapted to be connected to said first main section and having a top adapted to be separated therefrom to expose the stack of sheets during preparation of the carton for loading in the printing machine, said main sections when connected together forming the carton, said first main section being adapted to be manually positioned upon the platform to place said bottom panel with the stack supported thereon on top of the platform and with the top of the stack in operating association with the sheet feeding apparatus, and means for permitting the operator to slideably remove said bottom panel of said first main section relative to the platform and the stack and thereby effect the placement of the stack of sheets upon the sheet supply platform.

3. The disposable carton of claim 2 wherein said means for permitting the operator to slideably remove said bottom panel comprises a manually operable means connected to said bottom panel.

4. The disposable carton of claim 3 wherein said means for permitting the operator to slideably remove said bottom panel also includes a back panel positioned against the stack of sheets and being adapted to hold the stack in fixed position when the operator places a hand thereagainst as said bottom panel is being slideably removed.

5. The disposable carton of claim 2 including means for detachably securing said main sections to each other.

6. The disposable carton of claim 2 wherein said manually operable means is planar within the same plane as said bottom panel.

* * * * *